US011420818B2

(12) United States Patent
Poikonen et al.

(10) Patent No.: US 11,420,818 B2
(45) Date of Patent: Aug. 23, 2022

(54) MOVABLE COVER FOR FLUID CONTAINMENT TANKS

(71) Applicant: Dynatect Manufacturing, Inc., New Berlin, WI (US)

(72) Inventors: Brad Poikonen, Waukesha, WI (US); Steven Piacsek, Waukesha, WI (US); John Schwartz, Muskego, WI (US)

(73) Assignee: Dynatect Manufacturing, Inc., New Berlin, WI (US)

( * ) Notice: Subject to any disclaimer, the term of this patent is extended or adjusted under 35 U.S.C. 154(b) by 292 days.

(21) Appl. No.: 15/929,982

(22) Filed: Jun. 1, 2020

(65) Prior Publication Data

US 2021/0078795 A1 Mar. 18, 2021

Related U.S. Application Data

(60) Provisional application No. 62/901,017, filed on Sep. 16, 2019.

(51) Int. Cl.

*B65D 88/12* (2006.01)
*B65D 90/58* (2006.01)
*B65D 90/66* (2006.01)

(52) U.S. Cl.

CPC ..... *B65D 90/587* (2013.01); *B65D 88/125* (2013.01); *B65D 90/66* (2013.01); *B65D 2590/664* (2013.01)

(58) Field of Classification Search

CPC ..... B65D 90/587; B65D 90/66; B65D 2590/664; B65D 88/125

See application file for complete search history.

(56) References Cited

U.S. PATENT DOCUMENTS 3,977,719 A * 8/1976 Thurston ..... B60J 7/085 294/24
4,225,175 A * 9/1980 Fredin ..... B60J 7/085 160/68
4,858,253 A 8/1989 Lamb
4,893,864 A * 1/1990 Bailey ..... B60P 7/04 296/98
5,125,713 A * 6/1992 Willingham ..... B60J 7/085 160/242
5,179,991 A * 1/1993 Haddad, Jr. ..... B60J 7/085 160/310
5,253,914 A * 10/1993 Biancale ..... B60J 7/062 296/105
5,913,613 A 6/1999 Ragsdale et al.
6,053,556 A * 4/2000 Webb ..... B60J 7/085 296/100.15

(Continued)

*Primary Examiner* — Frederick C Nicolas
(74) *Attorney, Agent, or Firm* — James A. Joyce; Godfrey & Kahn. S.C.

(57) ABSTRACT

A system for covering fluid containment tanks to contain vapors and minimize evaporation of the vapors into the surrounding atmosphere. The system includes a flexible cover and restraint elements, guiding rails which support the cover over a tank and provide guidance for extending and retracting the flexible cover, a belt drive extends the leading end of the flexible cover and a drivable drum provides a way to retract the flexible cover and upon which the flexible cover will be rolled and stored, and a method to locate tank elements beneath the flexible cover system to prevent operating interferences.

20 Claims, 13 Drawing Sheets

(56) References Cited

U.S. PATENT DOCUMENTS

| | | | | |
|---|---|---|---|---|
| 6,474,718 | B1 * | 11/2002 | Henning | B65D 88/125 296/98 |
| 6,622,318 | B2 | 9/2003 | Mathis | |
| 2013/0062025 | A1 * | 3/2013 | Bromberek | B65D 88/125 160/242 |
| 2015/0165883 | A1 * | 6/2015 | Smith | B60J 7/085 220/262 |
| 2016/0347157 | A1 * | 12/2016 | Smith | B60J 7/085 |
| 2019/0225417 | A1 * | 7/2019 | Moxley | B65D 88/125 |
| 2022/0025700 | A1 * | 1/2022 | Reeder | B65D 90/66 |

* cited by examiner

MOVABLE COVER FOR FLUID CONTAINMENT TANKS

CROSS-REFERENCE TO RELATED APPLICATION

This application is based on and claims priority to U.S. Provisional Patent Application No. 62/901,017 filed on Sep. 16, 2019, which is incorporated herein by reference in its entirety for all purposes.

FIELD OF THE INVENTION

The present invention relates generally to the field of chemical tanks used for component finish processing. More particularly, the present invention relates to covers for finish processing tanks.

BACKGROUND

In the field of finish processing, tanks are used to contain chemicals for the purpose of submerging components to impart a particular surface finish, or coating, on the component. The components being finished are most commonly made of a base metallic material. A variety of chemicals are used to impart specific finishes to the components and these chemicals are stored in tanks into which the treated parts are submerged. The tanks exist in a variety of rectangular sizes depending on the end use of the components being finished.

An area of concern with firms that operate in the field of finish processing is vapor control of the chemicals used in the processing tanks. When the tanks are not being used for part treatment processing, the uncovered tanks are open to the atmosphere, and evaporative actions take place with the chemicals that are used in the process. There are two main reasons to contain vapors that are released from the processing tanks in which the chemicals are contained. One reason to contain the vapors is the release of volatile organic components. Regulatory agencies have restrictions on the amount of volatile organic compounds that companies can release into the environment. The evaporative nature of chemicals used in finish processing results in elevated volatile organic compounds released and therefore, containment is necessary. A second reason to contain the vapors that are released from the tanks is the cost of adding replacement chemicals and rebalancing the concentration of the chemicals in the tanks.

A common method of covering tanks used in finish processing, is to use sheets of common materials such as metallic plates or wood sheets. There are multiple drawbacks to this method of covering tanks. In the case of wood sheets, although the cost is low, wood is an absorptive material. As such, wood sheets will warp, thus allowing gaps between the tank surface and the sheet, reducing the containment of vapors. Additionally, when fluid vapor is absorbed into wood sheets, they become heavy and more difficult to handle. A third issue with using wood sheets is placing and removing sheets on tanks that are placed side by side in a finishing facility and are long enough to require multiple sheets of wood to properly cover each tank. Finally, wood sheets tend to be heavy and cumbersome for operators to move.

In order to eliminate some of the issues with using wood sheets to cover tanks, large metallic sheets are frequently used in their place. The metallic sheets do not absorb the fluid vapors. The metallic sheets, however, can become heavy due to their size and so they typically have hooks affixed for the purpose of placement and removal. Placement and removal of the metallic sheets is most commonly done by use of an overhead crane system. There are many issues related to this method of tank covering. The metallic sheets can only be placed or removed a single sheet at a time. Finish processing facilities commonly use long tanks and/or have many tanks that require placement and removal of metallic sheets. The process of placing and removal of tank covering plates is unproductive time that must take place at the beginning and end of each workday. Additionally, the metallic sheets require a storage location within the facility when the tanks are not covered adding to unproductive space within the facility.

There are additional tank covering methods that are found within the finish processing industry. One method is to use a metallic rolling cover that is driven out over the tank by use of a motor drive system. One such type of these metallic tank covers typically has a thin sheet of stainless steel and additional support ribs, most commonly aluminum, affixed to the stainless steel. The result of this construction is a thick cross section resulting in a large rolled up size when retracted off of the tank. Another such type of these metallic tank covers uses extruded aluminum slats that are joined in a hinging manner along common edges. These aluminum type tank covers provide a lower profile section height than the previously noted stainless steel and aluminum cover, and thus, a more compact rolled up design, however the low profile limits the operating width of the cover. These metallic cover systems have some beneficial features. They allow for very long lengths to be built as a one-piece cover. These metallic type tank covers can also satisfy the requirement of sealing in the chemical tank vapors and significantly reduces the time required to cover and uncover the tanks due to their one-piece construction and motor-powered actuation. Due to the rolled-up size of these types of covers, the associated storage size is considerable and must be stored at the end of the tank. A second drawback to metallic roll up cover is the cost to produce such a cover. For instance, building a long, single piece, roll up cover from stainless steel sheet with affixed aluminum support ribs, along with a motor drive system, is very costly to produce. One other drawback to a metallic roll up cover is that the metallic components will be affected by the corrosive nature of the vapors that are being contained. Unlike the single metallic sheet covering method, replacing corroded components in a roll up type metallic cover is very costly.

Another method of covering finish processing tanks is to use powered, rigid plastic sheets to cover the tanks. The rigid plastic sheets have a benefit of providing corrosion resistance to the vapors. The sheets however are typically hinged along a tank edge and then cover and uncover the tank by powered rotation of the sheet upward and downward. One drawback to this tank covering method is that the sheets stand vertically upward when rotated open so parts that are being submerged in the tanks must clear the rotated cover during transport to prevent collisions. An additional drawback to this type of rotating cover is that it is limited in the length of tank that can be covered with a single system. As the cover gets longer, it requires much more torque to rotate the cover open and closed, thus requiring a larger motor to drive the system. At some length, the system will not operate, or will be too costly due to the size of the powering components required for proper operation.

As such, there is a need for a product that can cover finish processing tanks in a variety of widths and lengths, contain vapors produced by the chemicals in the tanks, resist the corrosive nature of the vapors, be stored in a small area, be able to cover and uncover the tanks in a minimal amount of time, and be cost effective to produce.

SUMMARY OF INVENTION

A movable cover for selectively covering a fluid containment tank including a rotatable storage drum and a flexible cover attached at a first end to the storage drum such that when the storage drum rotates in a first direction, the flexible cover rolls onto the storage drum to uncover the fluid containment tank and wherein the storage drum rotates in a second direction when the flexible cover is rolled off of the storage drum to cover the fluid containment tank. A plurality of cover retaining devices is attached to the flexible cover and disposed on either side of the cover. A plurality of guide rails are disposed on either side of the fluid containment tank. The flexible cover extends into a cavity in each of the guide rails, each of which includes a guiding surface that selectively engages the cover retaining devices to suspend the flexible cover over the fluid tank. At least one drive cable extending along the length of the guide rails is attached to a lead bar that is attached to a second end of the flexible cover such that when the drive cable is driven, the lead bar and flexible cover move along the guide rails to selectively cover the fluid containment tank.

It will be understood by those skilled in the art that one or more aspects of this invention can meet certain objectives, while one or more other aspects can lead to certain other objectives. Other objects, features, benefits and advantages of the present invention will be apparent in this summary and descriptions of the disclosed embodiment, and will be readily apparent to those skilled in the art. Such objects, features, benefits and advantages will be apparent from the above as taken in conjunction with the accompanying figures and all reasonable inferences to be drawn therefrom.

DETAILED DESCRIPTION

This invention is a roll away cover system that includes a thin flexible cover made in some embodiments from a thin sheet of flexible plastic type material, that can roll onto a drum or spool in a small space. The roll away cover system may be powered manually or by commonly available, inexpensive, motor powered, rotating devices, and is restrained by a plurality of guide rails.

The cover is preferably a flexible plastic type material that is resistant to the corrosive effects of the vapors which are being contained by the cover. Some non-limiting examples of plastic materials that are resistant to corrosive chemicals are polyvinyl chloride (PVC), polyethylene, polypropylene, and polyvinylidene fluoride (PVDF). These plastic materials can come in the form of a film, a fabric that is woven from strands of the plastic, or a fabric that is coated with a film of the plastic. These materials are all common to the finish processing industry either as materials that the tanks are constructed from, as tanks liners that prevent contact between the chemicals and metallic tanks, or as tank covers. Of course, the cover may be made of any other suitable materials without departing from the invention.

Figure 1:
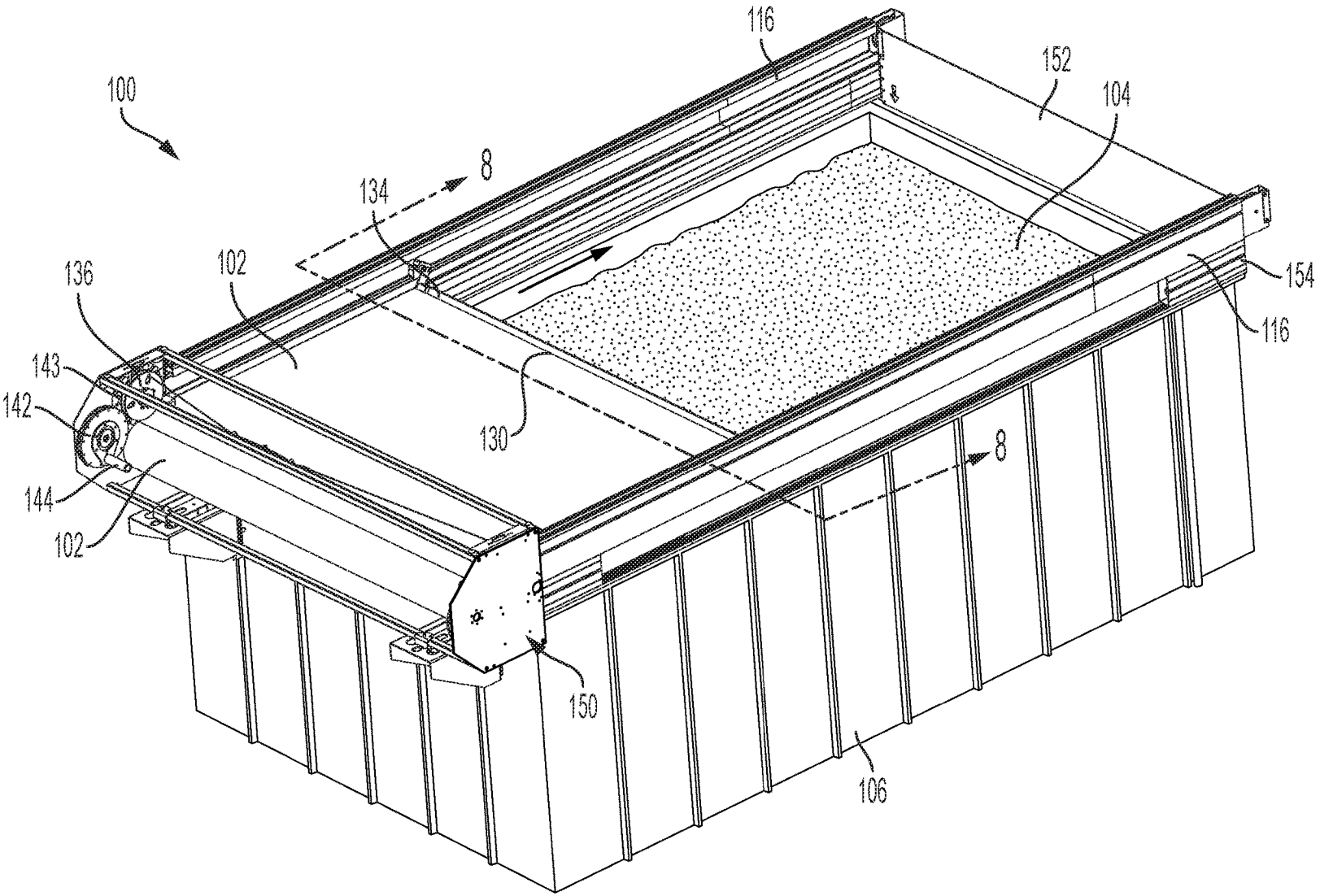
FIG. 1 is a perspective view of one embodiment of a movable cover for a fluid containment tank in accordance with the invention, showing a cable drive mechanism.
Figure 3:
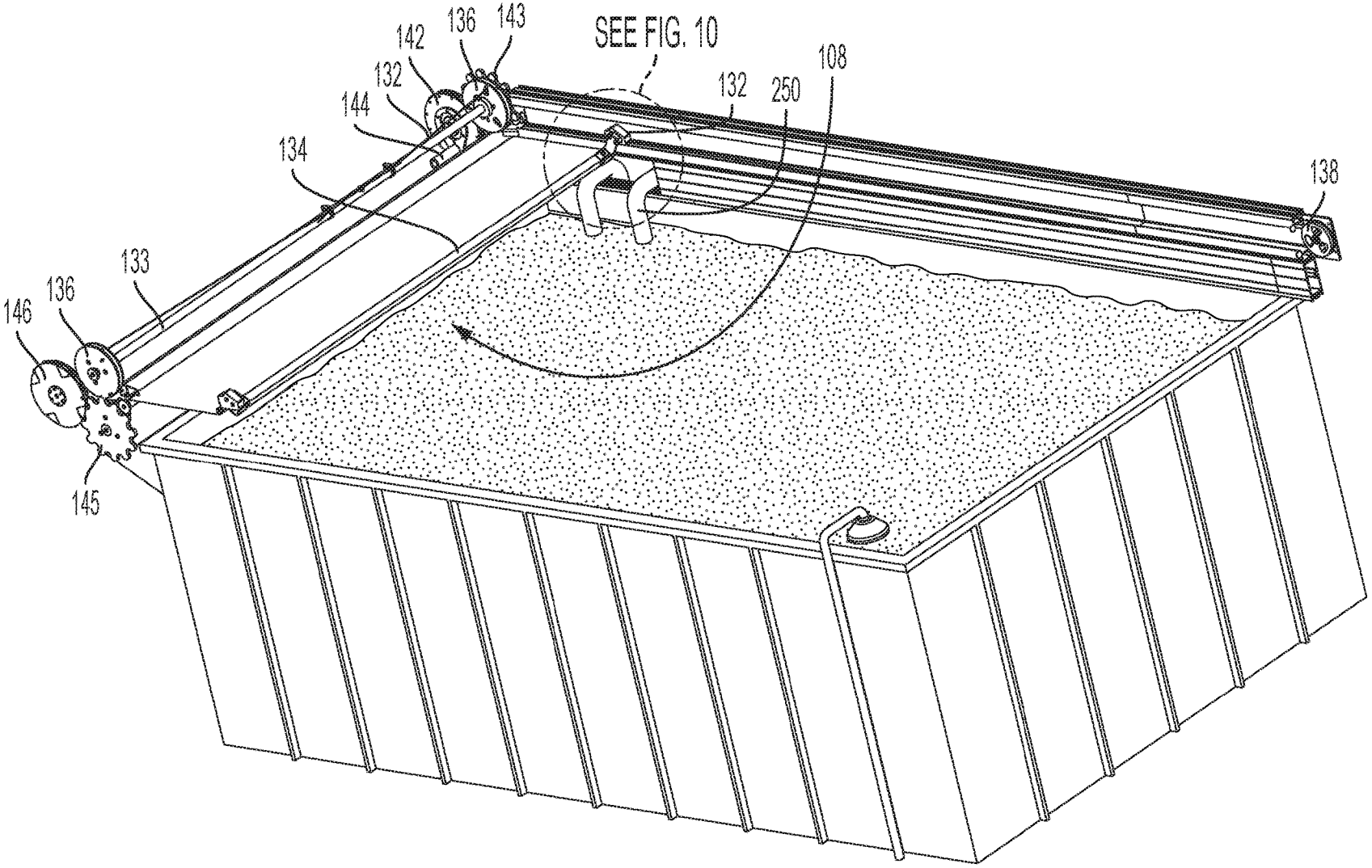
FIG. 3 is a perspective detail view of the movable cover for a fluid tank of FIG. 1, with one guide rail and a canister removed as indicated in FIG. 3.
Figure 4:
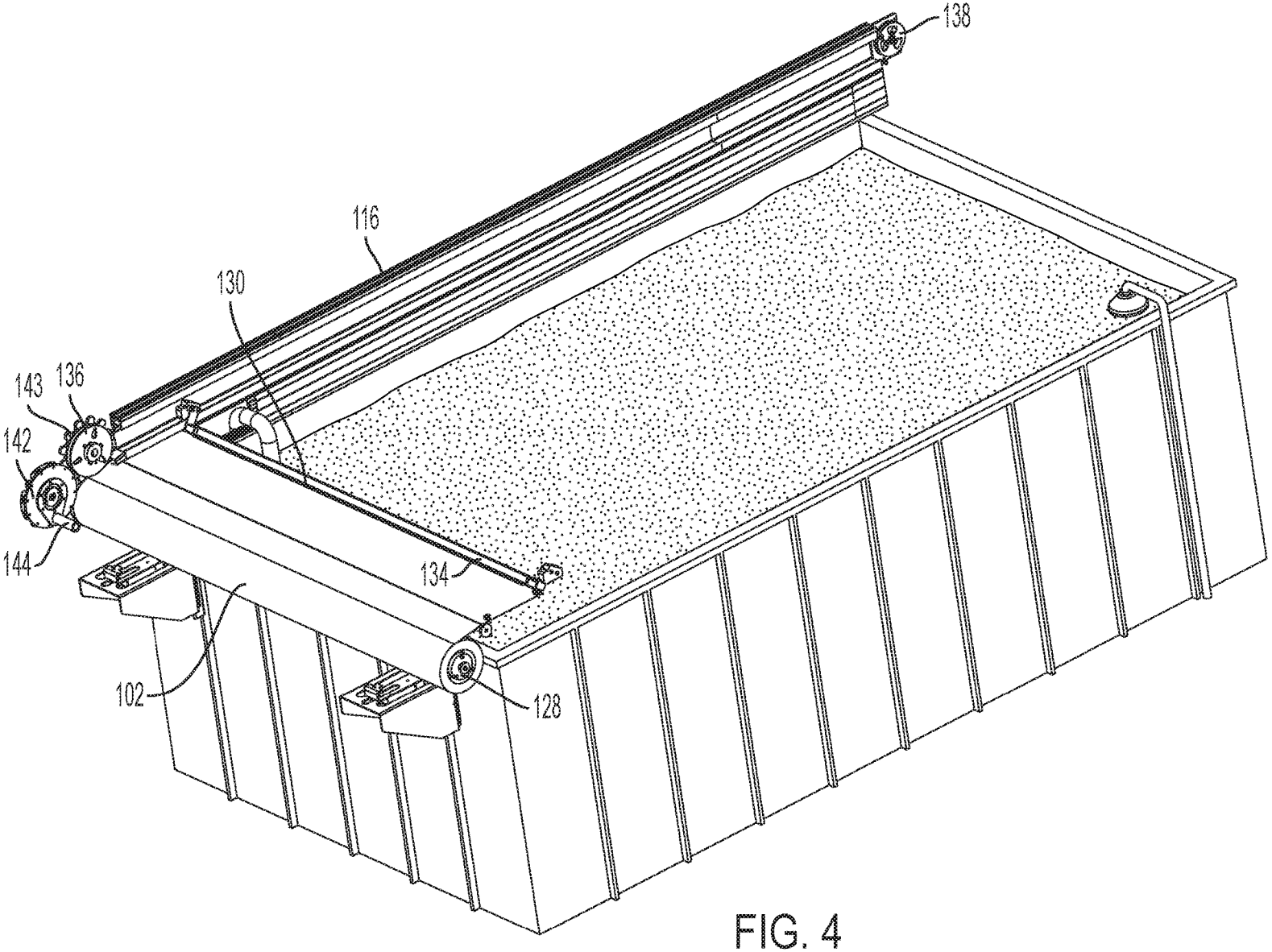
FIG. 4 is another perspective detail view of the movable cover for a fluid tank of FIG. 1, showing a cylindrical drum in greater detail.

Turning now to FIG. 1, one embodiment of a roll away cover system 100 in accordance with the invention is shown. Flexible cover 102 is suspended over a fluid 104 that is contained in a fluid holding tank 106 and is movable between a covered position and an uncovered position. An air gap 108 (see FIG. 3) is created between the fluid surface 110 and the underside 112 of flexible cover 102 (see FIG. 8). Flexible cover 102 is suspended over the fluid 104 and is carried out using a plurality of retaining devices 114 spaced along the lengthwise edges of cover 102.

As shown in FIGS. 1-4, two guide rails 116 are mounted to tank 106 and are typically made from one of the chemical resistant plastics previously described that are used for flexible cover 102 however, guide rails 116 may alternatively be made of any suitable corrosion resistant materials such as stainless steel, steel, aluminum, and other suitable plastic materials that have been coated with a chemical resistant coating. Some nonlimiting methods of producing guide rails 116 are extrusion, machining, 3D printing, and any other suitable fabrication methods depending on the materials used. In the embodiment shown, the guide rails 116 are made of extruded, chemical resistant plastic, that incorporate all of the features and surfaces necessary for the operation of the roll away cover system 100.

Figure 5:
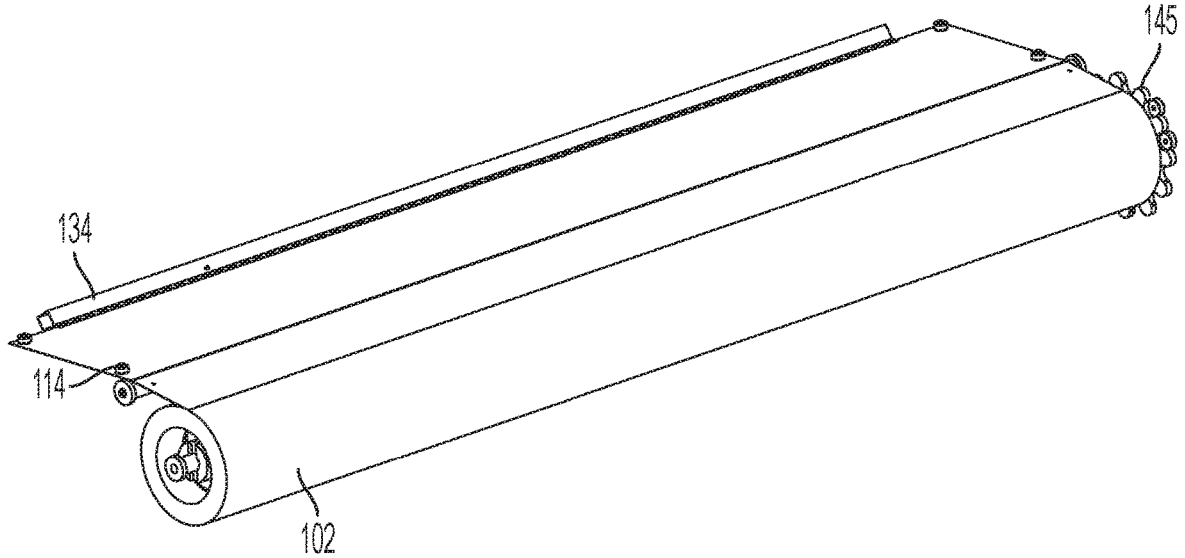
FIG. 5 is a perspective view the flexible cover rolled onto the cylindrical drum for the moveable cover for a fluid tank of FIG. 1.
Figure 6:
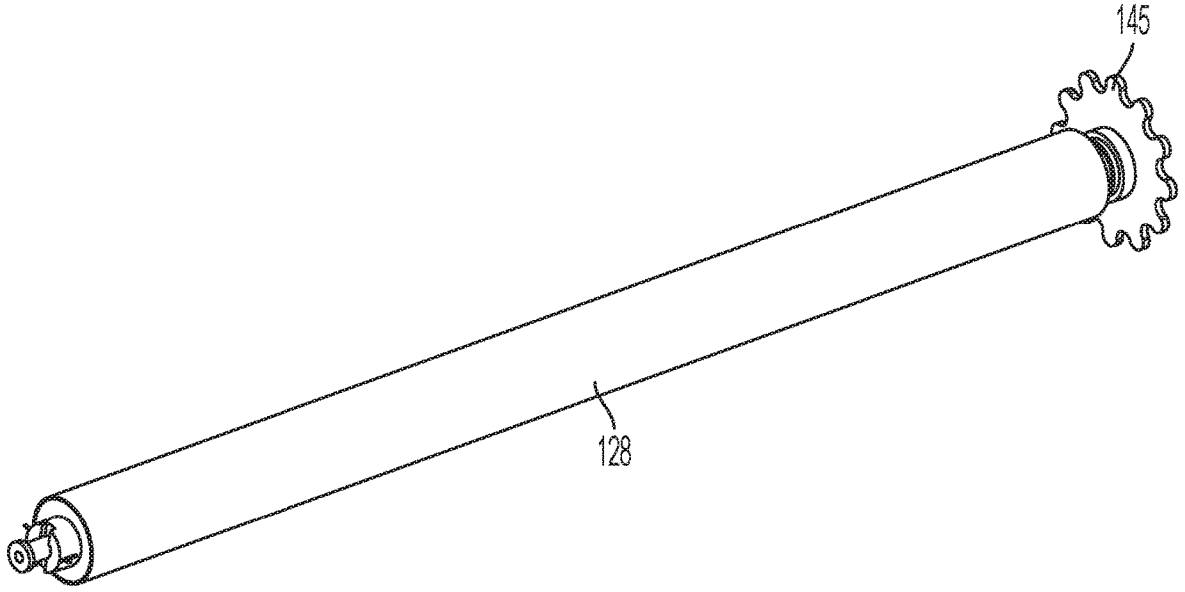
FIG. 6 is a perspective view of the cylindrical drum of FIG. 1.
Figure 7:
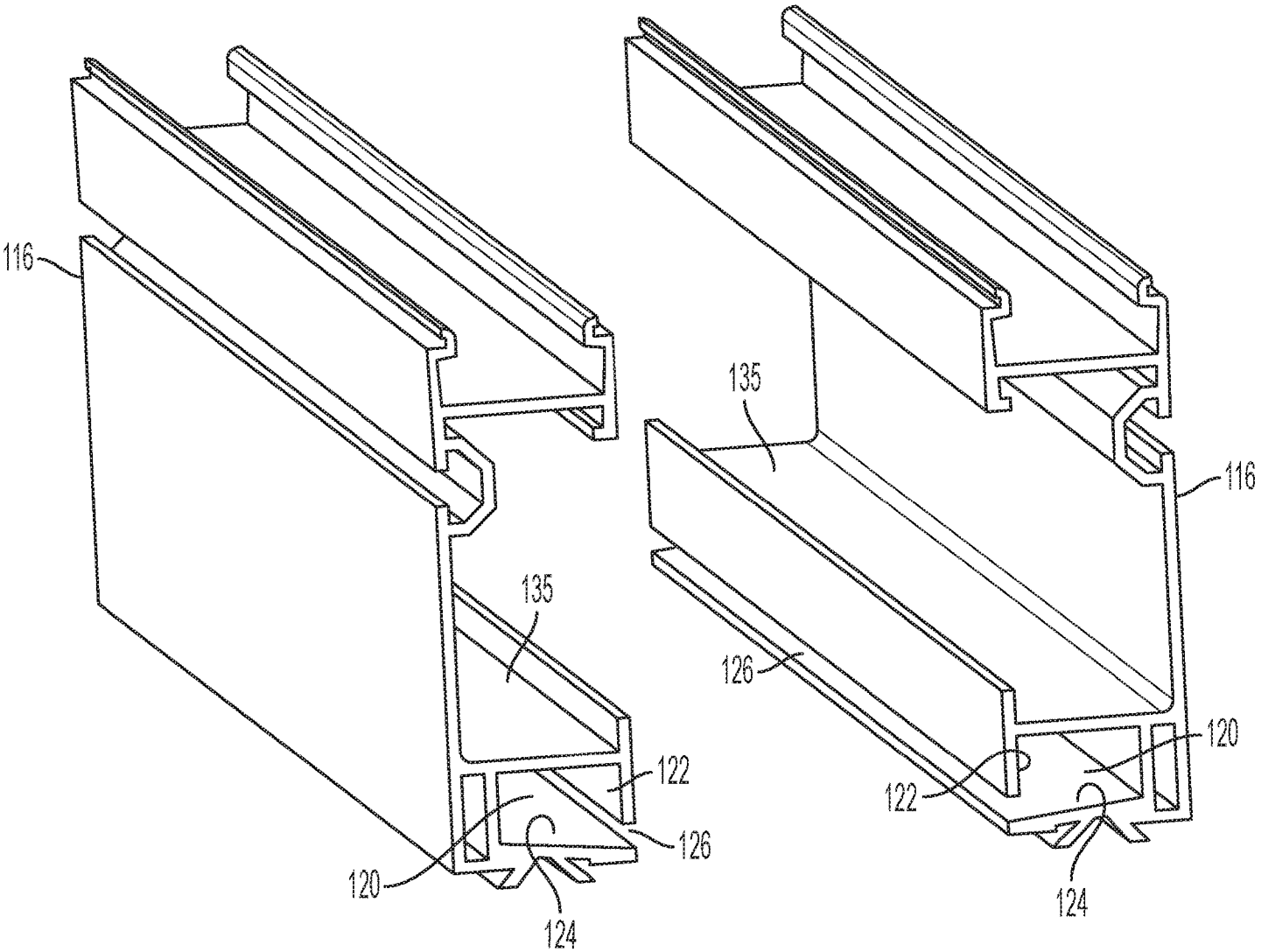
FIG. 7 is a detail perspective view of guide rails for the movable cover for a fluid containment tank of FIG. 1.

Turning now to FIGS. 5-9 the interaction between retaining devices 114 and guide rails 116 is shown. The guide rails 116 are typically mounted on each lengthwise side of the tank 106 although certain applications of the system 100 may require a widthwise side mounting of the guide rails to the tank. The guide rails 116 are typically mounted to the top surface of the tank 106 however, adaptations can be made to mount the guide rails to other surfaces of the tank, as desired. As shown in FIG. 7, each guide rail 116 includes an integral channel 120 that includes a guiding surface 122 and a downwardly sloped drainage surface 124. The guide rails 116 are mounted parallel to each other to allow a consistent space between guiding surfaces 122 which contact retaining devices 114.

Figure 8:
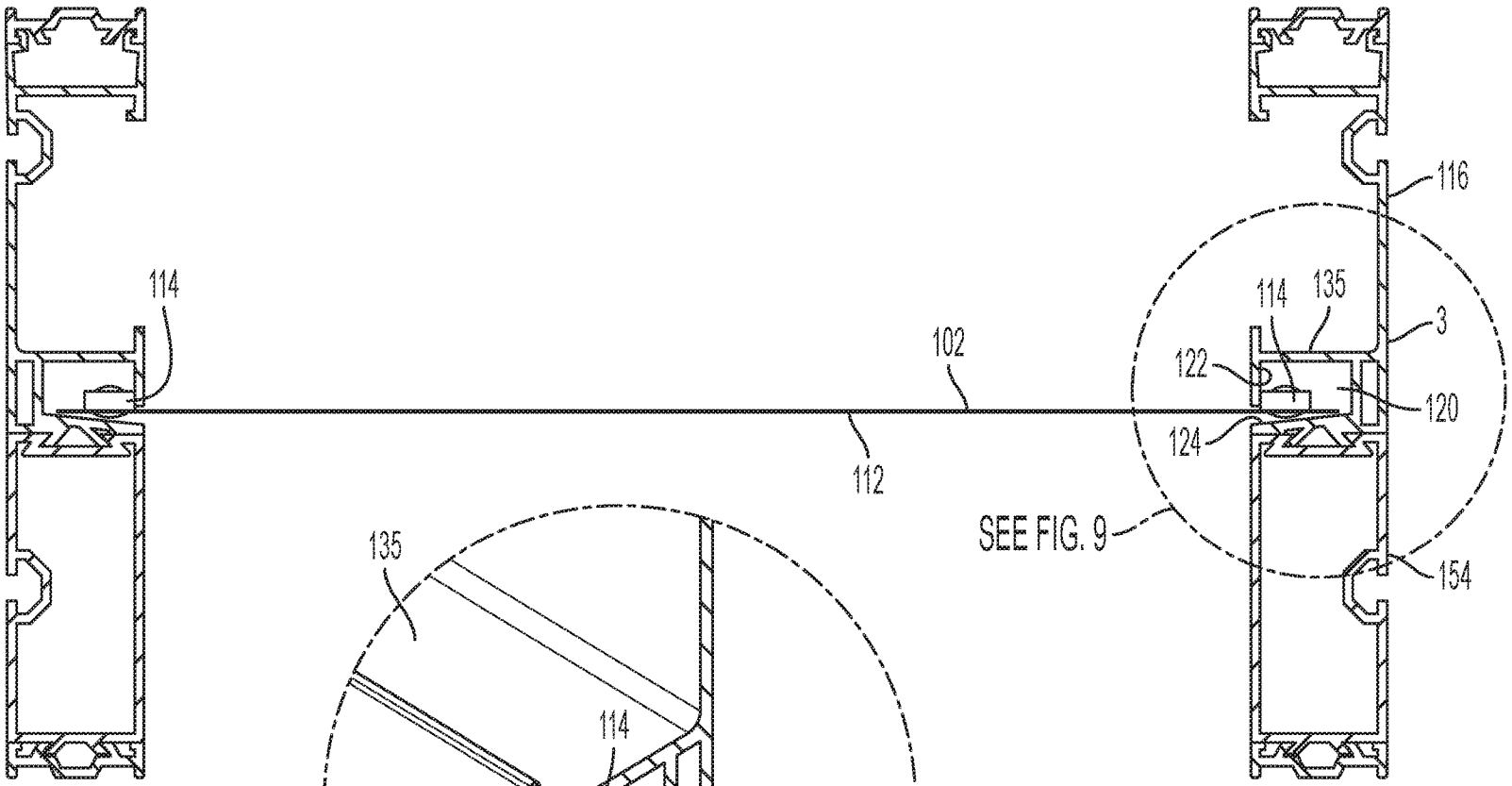
FIG. 8 is a cross-sectional detail view of movable cover for a fluid containment tank of FIG. 1 taken generally along the line 8-8 in FIG. 1.
Figure 9:
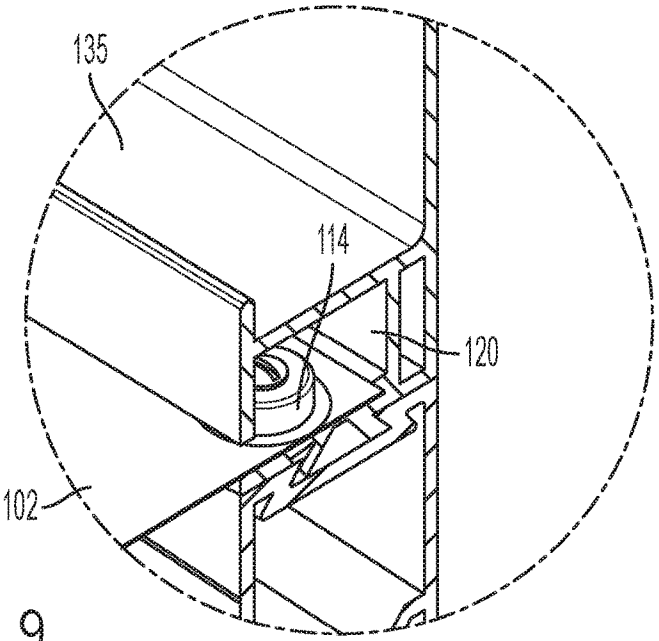
FIG. 9 is another cross-sectional detail view of a portion of guide rail for the movable cover for a fluid containment tank of FIG. 1 as indicated in FIG. 8.

As previously described, retaining devices 114 are secured on either side of flexible cover 102. During assembly or installation, retaining devices 114 are inserted into channels 120 which are temporarily open at the ends of guide rails 116. Retaining devices 114 travel through channels 120 and restrain flexible cover 102 as it travels along the length of guide rails 116 during extension and retraction operations that cover and uncover the fluid tank 106. In the embodiment shown, retaining devices 114 are made of chemical resistant plastic similar to those plastics that can be used for flexible cover 102, however alternate materials including, but not limited to stainless steel may be used without departing from the invention. In order to reduce the combined friction of the plurality of retaining devices 114 in contact with guiding surfaces 122, a low friction plastic, a rolling element design, or a combination of these may be used. Any other suitable material or element may be used for retaining devices 114 without departing from the invention. As shown in FIGS. 7-8, flexible cover 102 extends into channel 120 through a narrow gap 126 in each guide rail 116, which provides a minimal area through which generated tank vapors can pass from contained air space above the fluid 104 but below flexible cover 102 to the area outside of the flexible cover.

Figure 11:
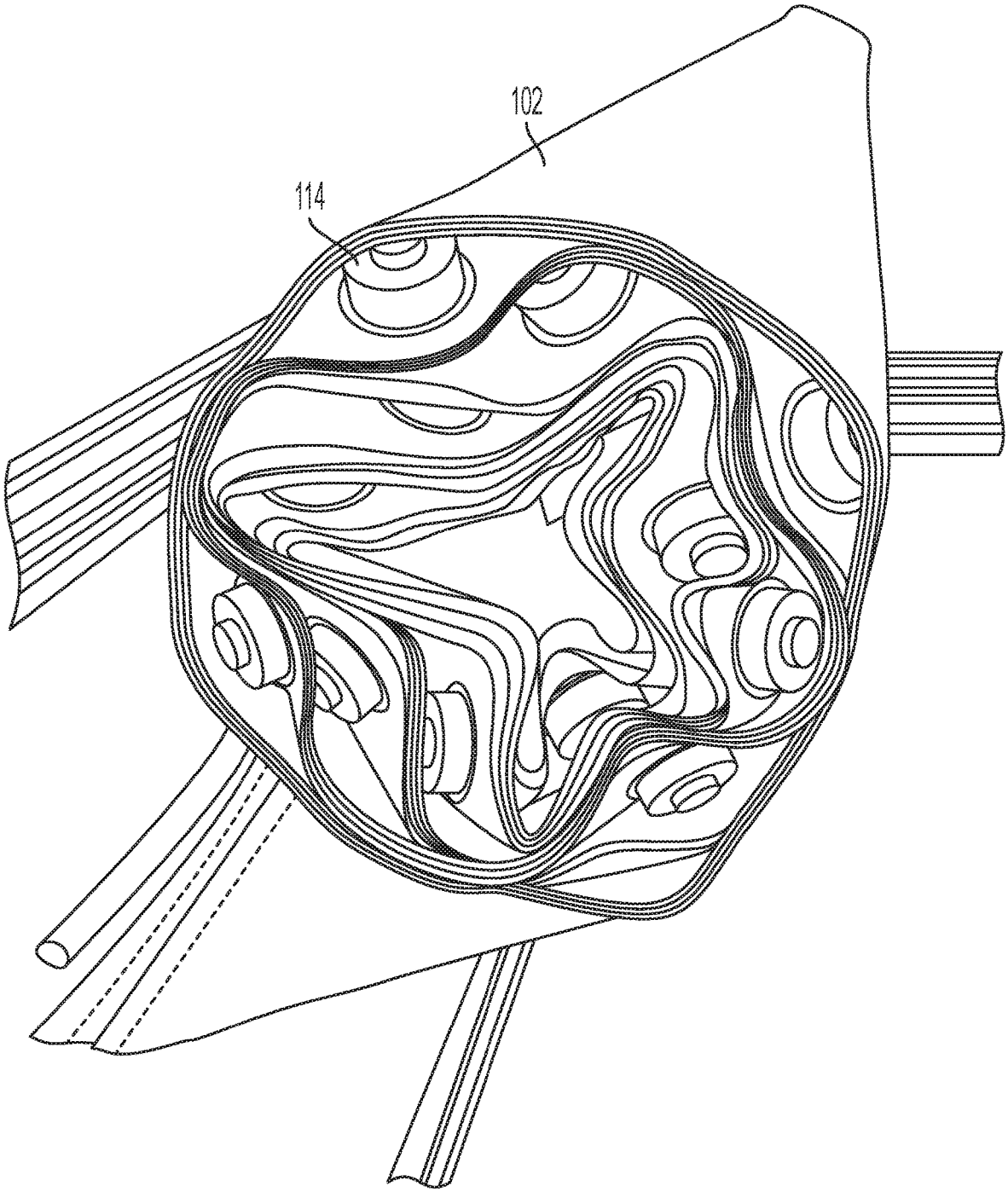
FIG. 11 is a perspective view of the flexible cover of FIG. 4 shown in a rolled position.

As previously described, flexible cover 102 is made of thin material and thus, allows the cover to be rolled up in a compact manner. As shown in FIGS. 5, 6, and 11, flexible cover 102 rolls up upon, and unrolls from, a cylindrical storage drum 128. In the embodiment shown, cylindrical drum 128 is made a chemical resistant plastic. However, drum 128 can alternatively be made from other materials such as steel, stainless steel, aluminum, plastic, or any other suitable material that can facilitate the requirements of rolling, and storing flexible cover 102. As shown in FIG. 1, the rolled up flexible cover 102, and cylindrical drum 128 storage system in the present embodiment are located at one end of the tank and below the top of tank 106. Other variations of this invention could have the storage location in alternative locations without departing from the invention. The storage location can be alternatively be along the length or width of the tank 106 depending on the access requirements of the user. As shown in FIG. 11, when flexible cover 102 is rolled onto cylindrical drum 128, retaining devices 114 are spaced apart to avoid stacking, thereby allowing the cover to be rolled up as compactly as possible. In addition, in the embodiment shown flexible cover 102 is wider than cylindrical drum 128, which leaves a hollow space into which the flexible cover and retaining devices 114 may fold inward, thereby allowing the flexible cover to wrap tightly around the drum, even though retaining devices are attached to the cover.

As shown in FIGS. 1-4, the mechanism enabling tank covering and uncovering operations is shown. The tank opening operation in this embodiment is carried out by use of a cable drive system to pull the leading edge 130 of the flexible cover 102 off the storage drum 128 for the entire length of guide rails 116 or as long as desired by the operator. In the embodiment shown, a cable 132 on each side of flexible cover 102 is used to pull the flexible cover from its rolled-up position on the storage drum 128. A lead bar 134 is attached to the leading edge 130, and one end of cable 132 is attached to each side of lead bar 134. Each side of lead bar 134 is further constrained within a channel 135 integrally formed in each guide rail 116. Lead bar 134 can move along the length of guide rail 116 while constrained within channels 135. The drive system operates in a standard cable drive system using a drive pulley 136 to determine the direction that cable 132 will move and an idler pulley 138 that guides the cable during opening and closing of cover 102. In the embodiment shown, drive pulley 136 is driven using a cable powering gear 142 that engages cable gear 143, which rotates the drive pulley in the desired direction, thereby causing flexible cover 102 to extend over tank 106. When cable 132 is retracted, it winds around axle 133 and is stored on drive pulley 136. Alternative ways of rotating drive pulley 136 include using a belt, chain, or friction device. Using any of the aforementioned or other suitable means of rotating the drive pulley 136 may be used without departing from the invention. While tank 106 is being covered, storage drum 128 is free to rotate, which allows flexible cover 102 to extend over the tank.

Figure 2:
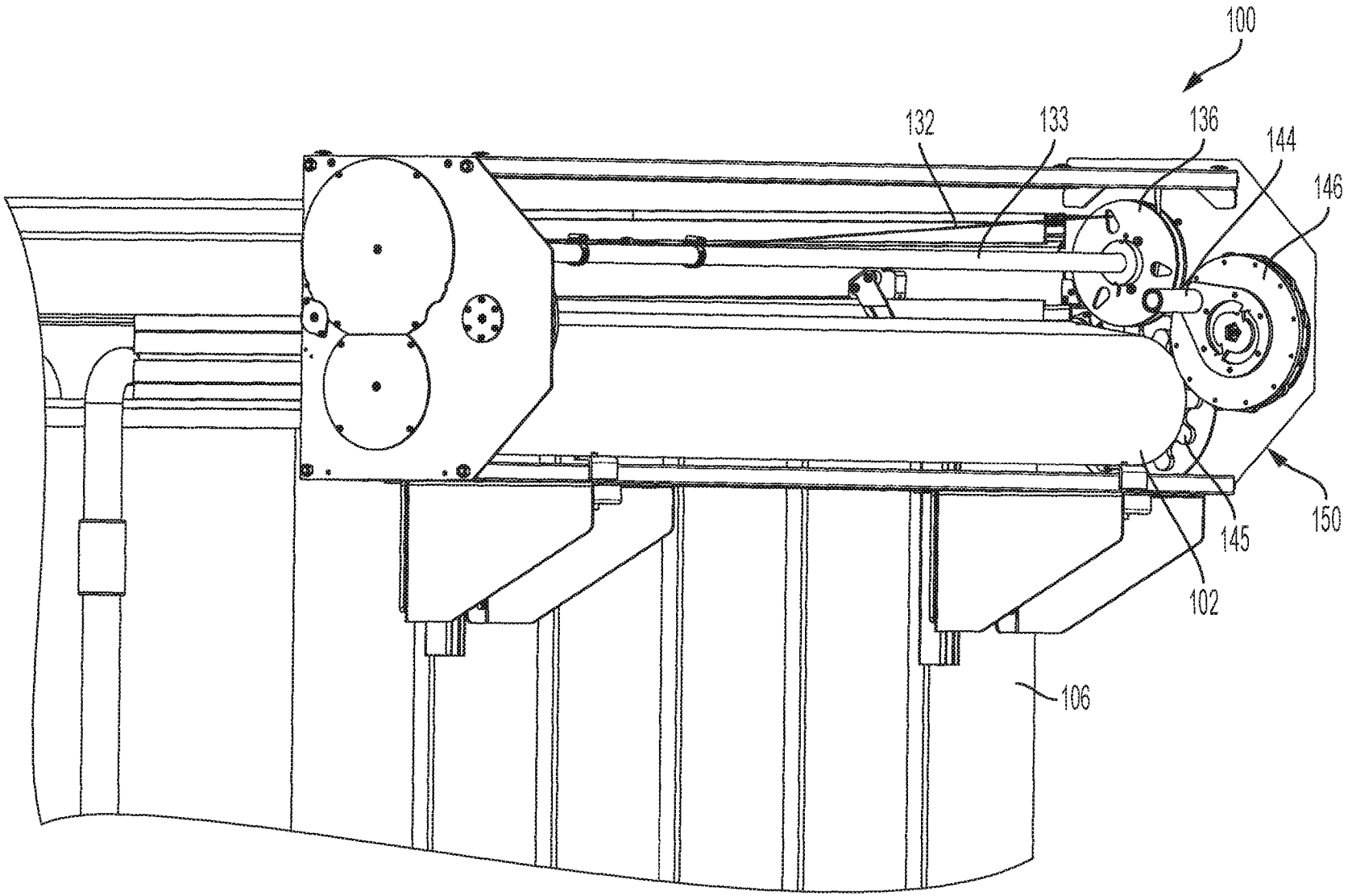
FIG. 2 is another perspective view of the movable cover for a fluid containment tank of FIG. 1, showing a drive mechanism for retracting the cover.

As further shown in FIG. 2, the tank uncovering operation in the present invention is performed by rotating the storage drum 128 in a direction that is opposite the drum rotation direction of the covering operation described in the previous paragraph. In the embodiment shown, storage drum 128 is driven directly using a cover powering gear 146, which engages a drum gear 145 to rotate the storage drum in the desired direction, thereby causing flexible cover 102 to roll onto the drum. Alternative ways of driving storage drum 128 may include using a belt, chain, or friction device. Using any of the aforementioned or other suitable means of rotating storage drum 128 may be used without departing from the invention. During the tank uncovering operation, drive pulley 136 is free to rotate, which allows flexible cover 102 to be retracted from its position covering tank 106.

Due to the lightweight construction of flexible cover 102, the amount of force necessary to drive the cover out during the tank covering operation does not require high powered, high torque drive device. The amount of force required to rotate the drive pulley 136 or to rotate the storage drum 128 will vary depending on the length and width of flexible cover 102. As the total mass of flexible cover 102 increases, or as the number of cover retaining devices 114 increases, the force necessary to extend and retract the flexible cover will also increase. The embodiment shown uses two methods to provide rotational power to the drive pulley 136 and storage drum 128. One method of providing rotational power is through use of a manual crank handle 144. As noted previously, flexible cover 102 extends over the tank through movement of cable 132 and retracts through rotational movement of storage drum 128. In the present embodiment, a separate manual crank handle 144 is used for each operation. Alternately, as the force required to extend and retract cover becomes too much for an operator to use manual crank handle 144, a handheld, commercially available drill, driver, or any other suitable motor may be used to rotationally move powering gears 142, 146 thus transferring the necessary movement and power to cable gear 143 or drum gear 145. An alternate powering method in this invention would be to eliminate the powering gears 142, 146 and then directly drive cable gear 143 or drum gear 145 through a crank handle or motor adaptation on the respective gears.

Roll away cover system 100 includes a canister 150 to contain the gears (142, 143, 145, 146), drum 128, and rolled up flexible cover 102 and serves as a first end close out to contain vapors from the tank. A second end close out is provided through provision of an opposite end wall 152 to which the lead bar 134 can be moved when flexible cover 102 is extended over the tank 106. Opposite end wall 152 serves to additionally contain vapors in tank 106.

Figure 10:
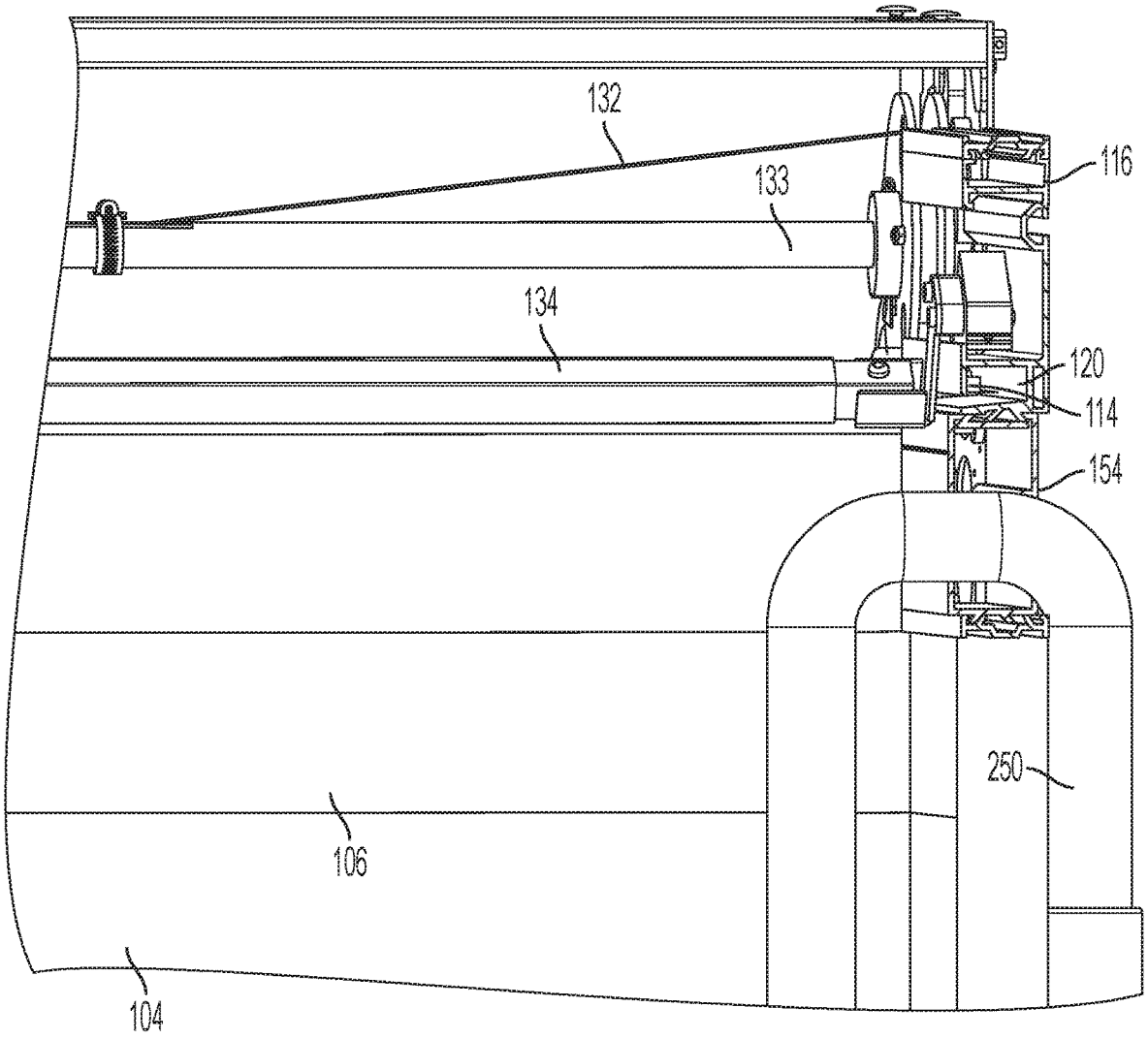
FIG. 10 is another detail perspective view of the movable cover for a fluid containment tank of FIG. 1.

An additional feature of this invention is the use of an optional guide rail rising element 154 to which the guide rail 116 can mount. The purpose of rising element 154 is to allow evaporative reclamation pipes, or fluid fill pipes 250 (see FIGS. 3, 10), to be located under flexible cover 102 when it extends and retracts in order to prevent interference between these pipes and the flexible cover.

Turning now to FIGS. 12-17, an alternative embodiment of a roll away cover system 200 in accordance with the invention is shown. Roll away cover 200 operates very similarly to the previously described embodiment, except the embodiment shown in FIGS. 12-17 replaces the cable drive with a continuous belt drive. In particular, the tank covering operation in this invention is carried out by use of a drive belt 202 to pull the leading edge of flexible cover 102 off of storage drum 128 for the entire length of the guide rails 116 or as long a desired by the operator. In the embodiment shown, a drive belt 202 on each side of the flexible cover 102 is used to pull the flexible cover from its rolled-up position on the storage drum 128. Drive belts 202 are continuous belts that extend along the length of guide rails 116. The loop ends may be joined together at the opposing ends or joined through a connecting device by any suitable means. The method of pulling the leading edge 130 of flexible cover 102 along the length of tank 106 is accomplished by attaching lead bar 134 to each side drive belt 202 and attaching the flexible cover 102 to the lead bar. The belt drive system operates in a standard continuous belt configuration using a drive pulley 204 to determine the direction that the belt will move, an idler pulley 206 that facilitates the return of the belt to form the continuous loop, and a tensioning device 208 (see FIG. 15) to prevent slipping of the belt 202 due to excessive slack in the belt during operation. In the embodiment shown, the drive pulley 204 is directly driven using belt powering gear 209, which engages belt gear 211 to rotate the drive pulley in the desired direction, and facilitates the extension of flexible cover 102 over tank 106. Any suitable alternative means of driving drive pulley 204 may be used without departing from the invention. During the tank covering operation, storage drum 128 is free to rotate, which allows flexible cover 102 to extend out over tank 106.

The tank uncovering operation in this embodiment is carried out by rotating the storage drum 128 in a direction that is opposite the drum rotation direction of the covering operation. In the embodiment shown, storage drum 128 is driven directly using cover powering gear 146, which engages drum gear 145 to rotate the storage drum in the desired direction to facilitate rolling up of flexible cover 102 onto the drum. Any suitable alternative means of driving storage drum 128 may be used without departing from the invention. During the tank uncovering operation, the drive pulley 204 is free to rotate allowing flexible cover 102 to be retracted from its position covering the tank.

As in the previously described embodiment, due to the lightweight construction of flexible cover 102, the means to drive the cover out during the tank covering operation does not require high powered, high torque drive device. The amount of force required to rotate drive pulley 204 or to rotate storage drum 128 will vary depending on the length and width of flexible cover 102. As the total mass of the flexible cover 102 increases, or as the number of cover retaining devices 114 increases, the force to extend and retract flexible cover 102 increases. This invention uses two methods to provide rotational power to drive pulley 204 and storage drum 128. One suitable method of providing rotational power to belt drive pulley 204 and storage drum 128 is through manual crank handle 144. As described previously, in the present embodiment flexible cover 102 extends over tank 106 through movement of drive belt 202 and retracts through rotational movement of storage drum 128. In the embodiment shown, a separate manual crank handle 144 is used for each operation. As previously described, any alternative means for providing the force required to extend and retract cover 102 may be used without departing from the invention.

Figure 12:
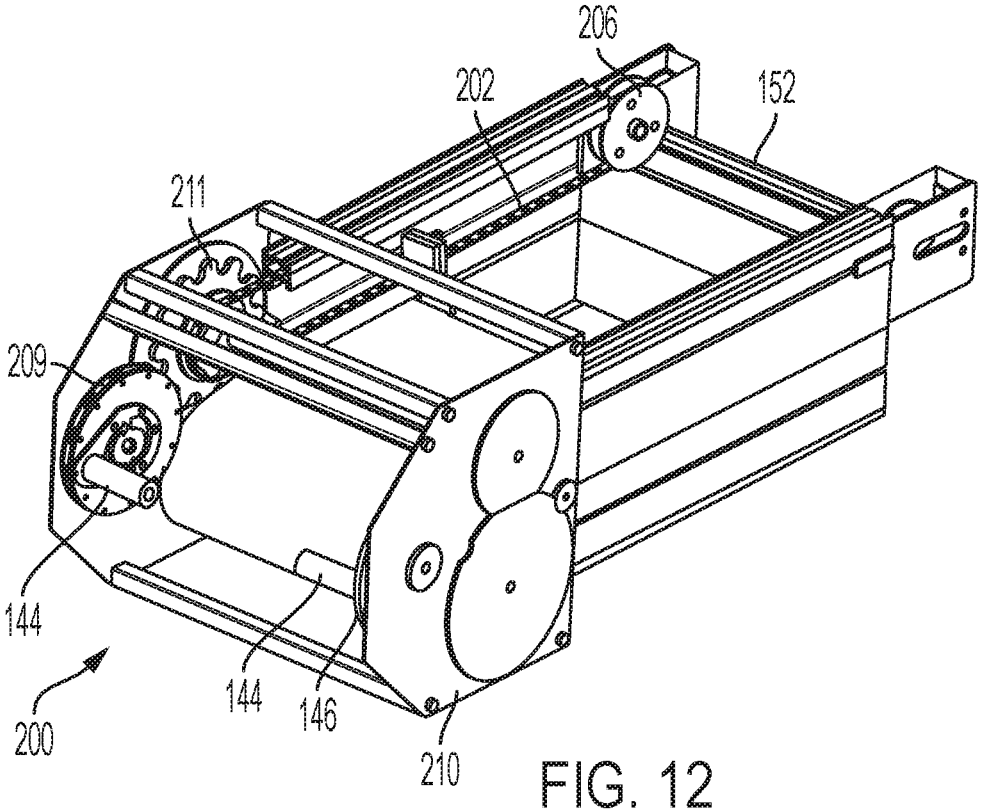
FIG. 12 is a perspective view of one embodiment of a movable cover for a fluid containment tank in accordance with the invention.
Figure 13:
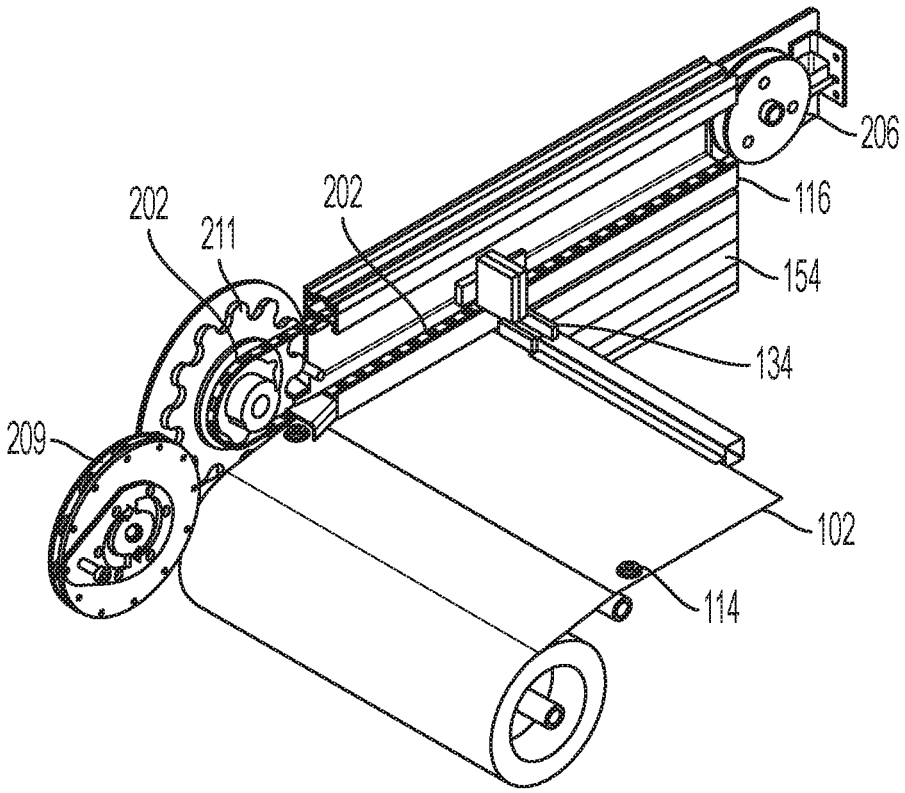
FIG. 13 is a detail perspective view of the movable cover of FIG. 12 showing a drive belt pulley.
Figure 14:
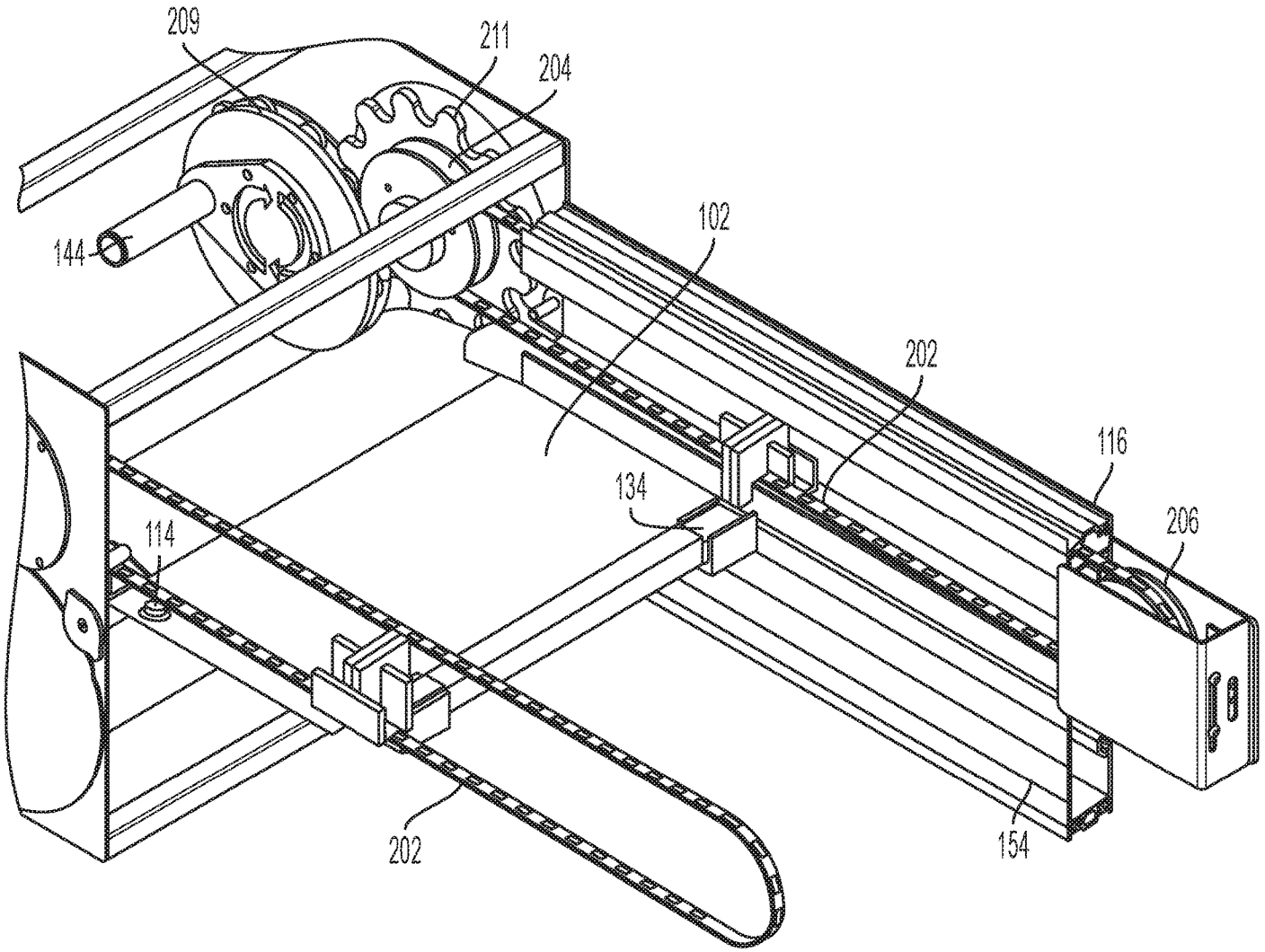
FIG. 14 is a detail perspective view of the movable cover of FIG. 12 showing a lead bar connecting the flexible cover to a drive belt.
Figure 15:
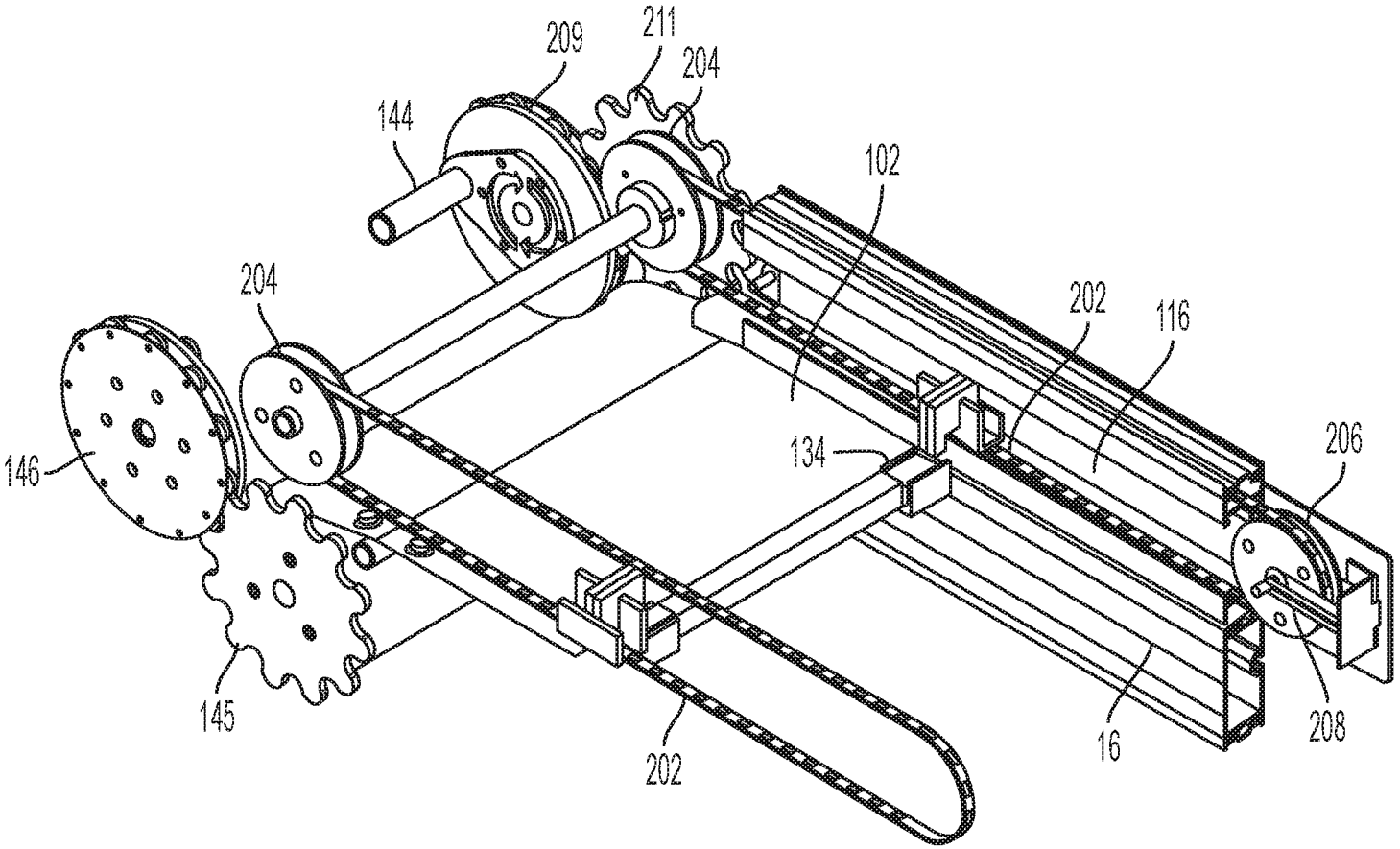
FIG. 15 is another perspective view of the movable cover of FIG. 12, showing the cover mechanism separated from the tank and with one guiderail removed.
Figure 16:
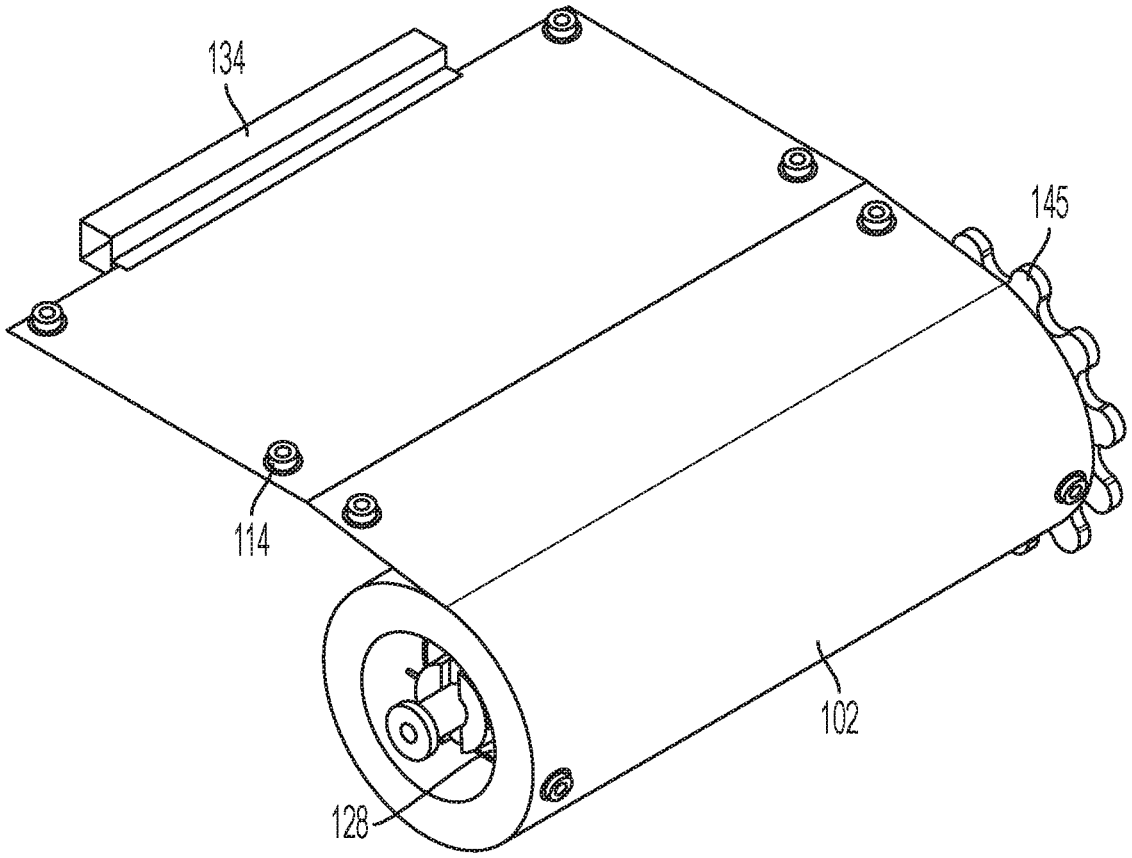
FIG. 16 is a perspective view of a flexible cover and a cylindrical drum of the movable cover of FIG. 12.
Figure 17:
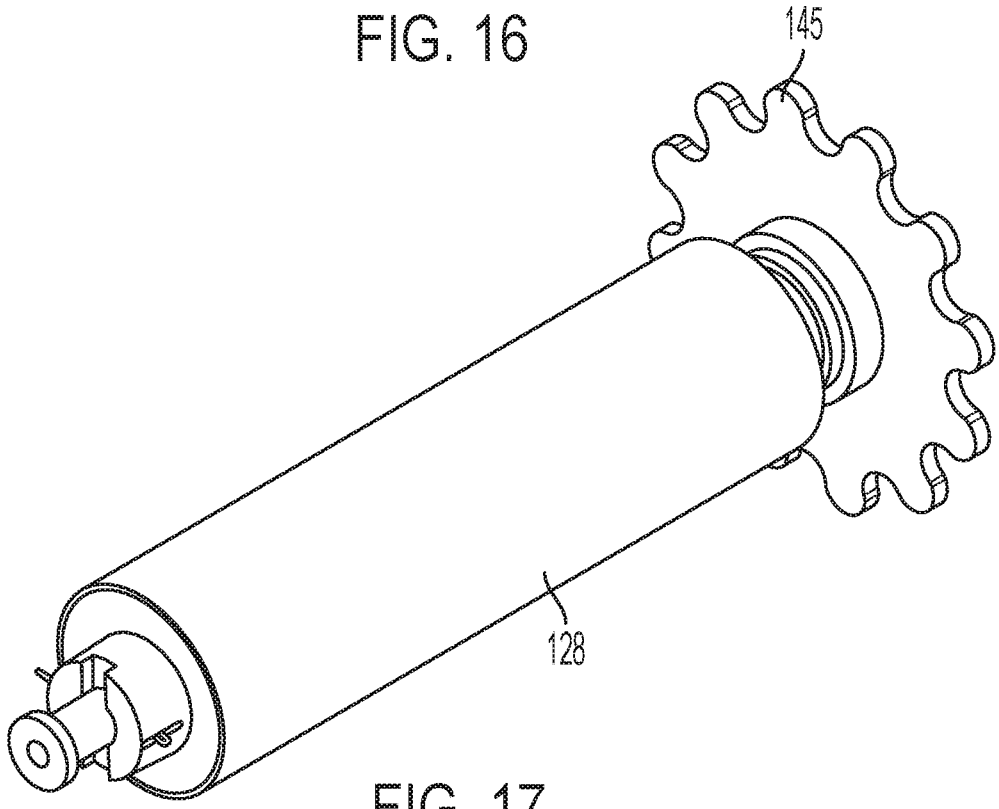
FIG. 17 is a perspective view of the cylindrical drum of FIG. 16.

As shown in FIG. 12, roll away cover system 200 uses a canister 210 to contain the gears (145, 146, 209, 211), storage drum 128, and rolled up flexible cover 102 and serves as a first end close out to contain vapors from tank 106. The second end close out is through provision of opposite end wall 152 to which lead bar 134 can be moved when the flexible cover 102 is extended over tank 106. This opposite end wall 152 serves to additionally contain vapors in tank 106.

As in the previous embodiment, this embodiment also shows the use of optional guide rail rising element 154 to which guide rail 116 is mounted, which allows evaporative reclamation pipes (not shown), or fluid fill pipes (not shown), to be located under flexible cover 102 when it extends and retracts in order to prevent interference between these pipes and the flexible cover 102.

Although the invention has been herein described in what is perceived to be the most practical and preferred embodiments, it is to be understood that the invention is not intended to be limited to the specific embodiments set forth above. Rather, it is recognized that modifications may be made by one of skill in the art of the invention without departing from the spirit or intent of the invention and, therefore, the invention is to be taken as including all reasonable equivalents to the subject matter of the appended claims and the description of the invention herein.

What is claimed is:

1. A movable cover for selectively covering a fluid containment tank comprising:

a rotatable storage drum;

a flexible cover attached at a first end to the storage drum such that when the storage drum rotates in a first direction, the flexible cover rolls onto the storage drum to uncover the fluid containment tank and wherein the storage drum rotates in a second direction when the flexible cover is rolled off of the storage drum to cover the fluid containment tank;

a plurality of cover retaining devices attached to the flexible cover and disposed on either side of the cover;

a plurality of guide rails disposed on either side of the fluid containment tank, wherein the flexible cover extends into a cavity in each of the guide rails;

each cavity including a guiding surface that selectively engages the cover retaining devices to suspend the flexible cover over the fluid tank;

at least one drive cable extending along the length of the guide rails; and a lead bar attached to a second end of the flexible cover, wherein the lead bar is attached to the drive cable such that when the drive cable is driven, the lead bar and flexible cover move along the guide rails to selectively cover the fluid containment tank.

2. The movable cover of claim 1, wherein each cavity includes a sloped drainage surface to allow any fluid present in the cavity to drain out of the cavity.

3. The movable cover of claim 1, wherein the cover retaining devices rotate to reduce friction between the cover retaining devices and the guiding surface.

4. The movable cover of claim 1, wherein the cover extends into each cavity through a sufficiently narrow gap to prevent tank vapors from escaping when the cover is covering the fluid containment tank.

5. The movable cover of claim 1, wherein the width of the flexible cover is greater than the width of the storage drum, such that when the flexible cover is rolled onto the storage drum, a hollow space is formed, allowing the flexible cover to wrap tightly around the storage drum.

6. The movable cover of claim 1, further comprising a cable powering gear rotatably engaged with a cable gear.

7. The movable cover of claim 6, wherein the cable powering gear includes a manual crank handle.

8. The movable cover of claim 6, wherein the cable powering cable is rotatably engaged with an electric motor.

9. The movable cover of claim 1, further comprising a cover powering gear rotatably engaged with the storage drum.

10. The movable cover of claim 9, wherein the cover powering gear includes a manual crank handle.

11. The movable cover of claim 9, wherein the cover powering gear is rotatably engaged with an electric motor.

12. The movable cover of claim 1, further comprising an idler pulley.

13. The movable cover of claim 1, further comprising a first end closeout and a second end closeout attached to opposite walls of the tank to prevent tank vapors from escaping when the cover is covering the fluid containment tank.

14. A movable cover for selectively covering a fluid containment tank comprising:

a rotatable storage drum;

a flexible cover attached at a first end to the storage drum such that when the storage drum rotates in a first direction, the flexible cover rolls onto the storage drum to uncover the fluid containment tank and wherein the storage drum rotates in a second direction when the flexible cover is rolled off of the storage drum to cover the fluid containment tank;

a plurality of cover retaining devices attached to the flexible cover and disposed on either side of the cover;

a plurality of guide rails disposed on either side of the fluid containment tank, wherein the flexible cover extends into a cavity in each of the guide rails;

each cavity including a guiding surface that selectively engages the cover retaining devices to suspend the flexible cover over the fluid tank;

at least one drive belt extending along the length of the guide rails; and a lead bar removably attached to a second end of the flexible cover, wherein the lead bar is attached to the drive belt such that when the drive belt is driven, the lead bar and flexible cover move along the guide rails to selectively cover the fluid containment tank.

15. The movable cover of claim 14, wherein each cavity includes a sloped drainage surface to allow any fluid present in the cavity to drain out of the cavity.

16. The movable cover of claim 14, wherein the width of the flexible cover is greater than the width of the storage drum, such that when the flexible cover is rolled onto the storage drum, a hollow space is formed, allowing the flexible cover to wrap tightly around the storage drum.

17. The movable cover of claim 14, further comprising a belt powering gear rotatably engaged with a belt gear.

18. The movable cover of claim 17 wherein the belt powering gear includes a manual crank handle.

19. The movable cover of claim 14, further comprising a cover powering gear rotatably engaged with the storage drum.

20. The movable cover of claim 19, wherein the cover powering gear includes a manual crank handle.

* * * * *